United States Patent [19]

Smith

[11] 4,078,986

[45] Mar. 14, 1978

[54] ELECTROLYTIC DIAPHRAGM CELLS

[75] Inventor: Frank Smith, Runcorn, England

[73] Assignee: Imperial Chemical Industries Limited, London, England

[21] Appl. No.: 652,852

[22] Filed: Jan. 27, 1976

[30] Foreign Application Priority Data

Jan. 30, 1975 United Kingdom ..... 4097/75

[51] Int. Cl.[2] ..... C25B 1/16; C25B 1/26; C25B 9/02; C25B 9/04

[52] U.S. Cl. ..... 204/258; 204/252; 204/266; 204/286; 204/297 R

[58] Field of Search ..... 204/266, 252, 263, 280, 204/286, 288, 297 R, 258

[56] References Cited

U.S. PATENT DOCUMENTS

| | | | |
|---|---|---|---|
| 3,591,483 | 7/1971 | Loftfield et al. | 204/252 |
| 3,598,715 | 8/1971 | Goens et al. | 204/288 X |
| 3,719,578 | 3/1973 | Berthoux et al. | 204/252 |
| 3,891,531 | 6/1975 | Bouy et al. | 204/263 |
| 3,954,593 | 5/1976 | Schmidt | 204/266 X |
| 3,963,595 | 6/1976 | Danna | 204/288 X |
| 3,963,596 | 6/1976 | Kircher | 204/286 X |

*Primary Examiner*—Arthur C. Prescott
*Attorney, Agent, or Firm*—Cushman, Darby & Cushman

[57] ABSTRACT

An anode assembly for an electrolytic cell comprising a base plate of an electrically-conductive metal which is resistant to the electrolyte used in the cell, a plurality of metal anodes mounted on and attached in electrical contact with the upper surface of the base plate and a current lead-in member or members electrically and mechanically bonded to the under surface of the base plate by means of a plurality of electrically-conducting stud members each of which is connected by welding at one end to the under surface of the base plate and is connected at the other end by welding or other means to said current lead-in member or members.

13 Claims, 4 Drawing Figures

ELECTROLYTIC DIAPHRAGM CELLS

This invention relates to improvements in electrolytic cells.

More particularly, the invention relates improvements in diaphragm cells for the electrolysis of aqueous solutions of alkali metal halides.

In recent years graphite anodes for electrolytic diaphragm cells have been superseded by permanent anodes fabricated from electrolyte-resistant metals such as titanium. In the case of consumable graphite anodes it was common practice to have the lower ends of the anodes connected to copper conductor bars or alternatively cast in a lead slab which formed part of the base of the cells. A protective coating such as concrete or bitumen was then applied to protect the conductor bars or lead casting from the corrosive effect of chlorinated brine during operation of the cell. The introduction of metal anodes provided with an electrolytically-active coating resulted in significant changes in the design of anode assemblies for diaphragm cells. These changes resulted partly from the fact that the coated metal anodes had a considerably longer working life than comparable graphite anodes. More important, however, was the fact that whilst a graphite anode is consumed during operation of the cell and has to be replaced by a new anode when its active life has terminated, a metal anode simply has to be re-coated when its electrocatalytically-active coating has reached the end of its working life. It follows that the cumbersome techniques employed for protecting the current lead-in means for graphite anodes were not suitable for metal anodes which had to be easily removable from the cells for re-coating. At the same time however the means for leading current in to the lower ends of the metal anodes had still to be protected from the corrosive effects of the electrolyte. Experience showed that in the case of metal anodes the best results were obtained by providing the cell with a base constructed of a metal which was electrically-conductive and also unattacked by the electrolyte used in the cell. For economic reasons titanium has proved to be the most suitable metal for the construction of such cell bases. In such a construction the metal anodes are mounted on one side of the titanium base and an electrical conductor or conductors bonded to the other side of the base so as to lead current into the metal anodes.

Examples of diaphragm cells fitted with metal bases are disclosed in UK Pat. Specification Nos. 1,125,493 and 1,127,484. In both cases coated titanium anodes are releasably mounted on rib members which act as anode supports and which are fitted to one side of a titanium base plate. Copper, aluminium or steel conductors are mechanically and electrically-bonded to the underside of the base plate in the vicinity of the metal anodes. Several methods of effecting the bond between the titanium base plate and copper, aluminium or steel conductors are described. For example, the conductor may take the form of a single sheet of metal bonded to the entire base plate or, alternatively, a series of parallel strips of the conductor metal may be bonded to the under-surface of the base plate directly beneath the anode supports. Steel or copper conductor plates may be clad with titanium by providing an interlayer of bond-promoting metal or alloy and rolling the metals together. Alternatively, the metals may be joined together by explosion-bonding. They may also be bonded together locally by resistance-welding. In the case where the conductors are of copper, soldering or brazing of the conductors to the titanium base plate is preferred. Finally, when aluminium is used as the conductor material the bond may be effected by casting molten aluminium on to the titanium base.

According to the present invention we provide an anode assembly for an electrolytic cell comprising a base plate of an electrically-conductive metal which is resistant to the electrolyte used in the cell, a plurality of metal anodes mounted on and attached in electrical contact with the upper surface of the base plate and a current lead-in member or members electrically and mechanically-bonded to the under-surface of the base plate by means of a plurality of electrically-conducting stud members each of which is connected by welding at one end to the under-surface of said base plate and is connected at the other end by welding or other means to said current lead-in member or members.

Preferably, said stud members are bonded to the under-surface of the base plate by friction-welding or capacitor discharge stud-welding.

The current lead-in member or members and the stud members can be of any suitable electrically-conducting material but in a preferred embodiment of the invention they are of aluminium, which is particularly suitable for friction-welding to titanium. Alternatively they can be of copper or steel. In yet another embodiment of the invention titanium studs can be used and in this instance the titanium studs are friction-welded at one end to the under-surface of the metal base plate and an aluminium, copper or steel current lead-in member or members is bolted on to the other ends of the titanium studs. However, if the current lead-in member or members and the stud members are of the same material they can be joined easily, e.g. by fusion-welding.

Preferably, the upper surface of the metal base plate is provided with a series of spaced parallel anode support members of a material which is electrically-conductive and which is resistant to the electrolyte used in the cell and the anodes are welded to said support members.

Alternatively, the anodes may be welded directly on to the upper surface of the metal base plate.

In yet another embodiment the anode support members may take the form of rows of spaced studs or posts which may be friction-welded or capacitor discharge stud-welded to the upper surface of the metal base plate. Alternatively, the anode support members may take the form of ribs which can be mounted on the metal base plate by more conventional welding techniques.

Further preferably, the base plate and the anode support members are made from titanium. Tantalum or niobium however may also be used. Alloys of the aforesaid metals are also suitable.

The anodes are preferably made from titanium or a titanium-base alloy having anodic polarisation properties similar to those of titanium.

The anodes can be provided with any of the electrocatalytically-active coatings known in the art. For example coatings based on a platinum group metal oxide, e.g. ruthenium oxide may be used. Alternatively, the coating may comprise a platinum group metal or alloys thereof, e.g. platinum or platinum-iridium respectively.

The current lead-in members which are bonded to the under-surface of the metal base plate are of a metal of greater electrical-conductivity than that of the base plate and as aforesaid preferably are made from copper, aluminium or steel.

The current lead-in member may take the form of a single sheet of metal bonded by means of studs to the entire under-surface of the base plate or alternatively may take the form of a series of parallel strips bonded by means of studs to the under-surface of the metal base plate directly beneath the anodes or the anode support members as the case may be.

The current lead-in member of members may be of tapering cross-section decreasing in the direction of diminishing current.

It is preferred that the anodes are non-releasably mounted on the spaced parallel anode support members by welding as this gives a joint with less tendency to deteriorate in service.

The present invention is also an electrolytic cell fitted with an anode assembly as described above.

Embodiments of the invention will now be described simply by way of example with reference to the accompanying drawings in which.

Figure 1:
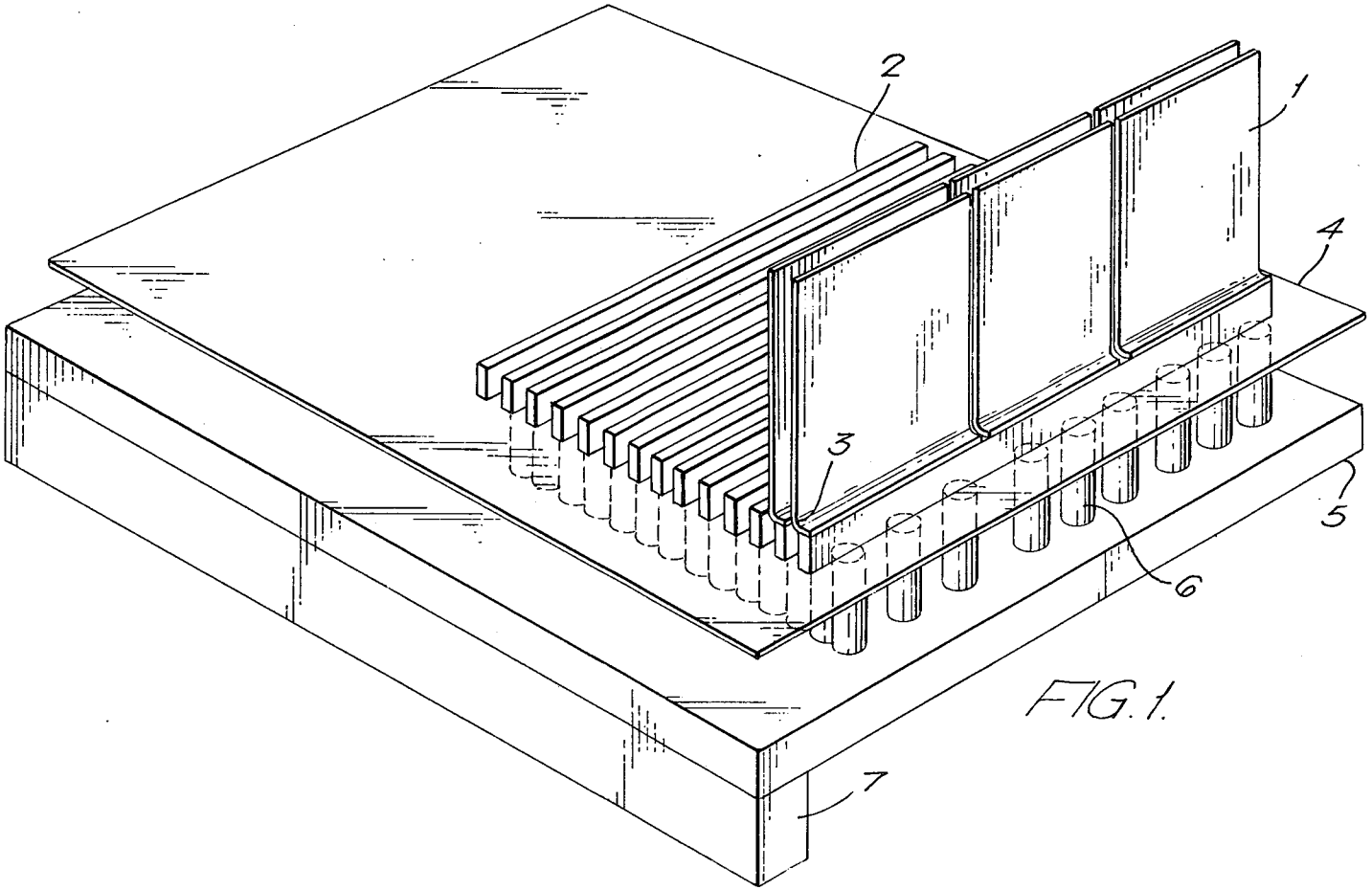
FIG. 1 is a schematic view of a friction welded anode assembly according to the invention with only two banks of anodes shown for clarity.
Figure 2:
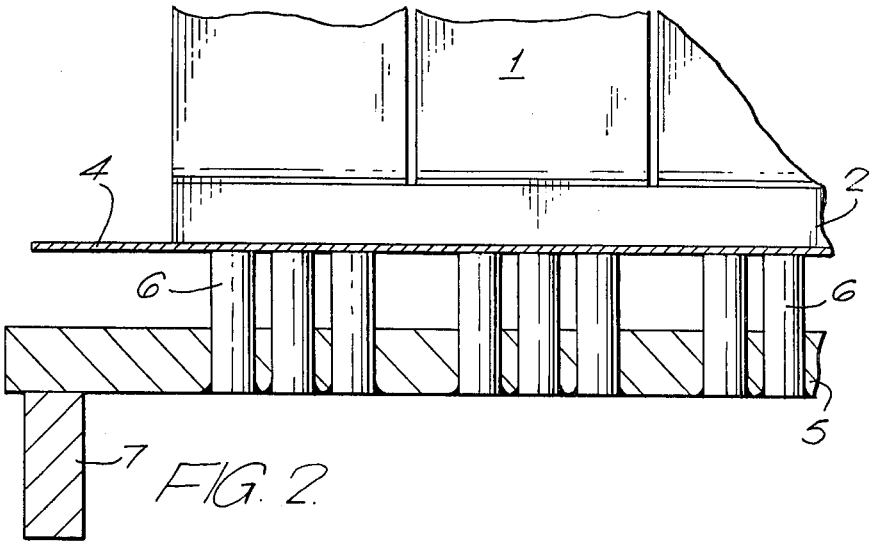
FIG. 2 is a front elevation of part of the anode assembly of FIG. 1.
Figure 3:
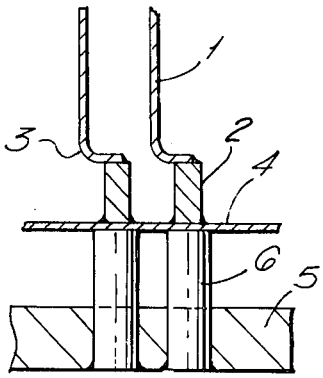
FIG. 3 is a side elevation of part of the anode assembly of FIG. 1.

Referring to FIGS. 1 to 3 of the drawings, a plurality of sheet anodes 1 fabricated of titanium and provided with an electrocatalytically-active coating are fillet-welded to a series of parallel vertically-disposed spaced apart titanium anode support ribs 2. The anodes 1 are folded over at their lower ends 3 so that the welding of the anodes 1 to the support ribs 2 will not distort the anode sheets. The support ribs 2 are argon-arc welded along their lengths to a titanium sheet 4 which serves as the base plate of the cell. The titanium base plate 4 is connected to a current lead-in member in the form of a slotted aluminium plate 5 by a plurality of aluminium studs 6. The aluminium studs 6 are friction-welded at their top ends to the underside of the titanium base plate 4. At their lower ends the aluminium studs 6 are sunk into and hand-welded to the aluminium plate 5. The aluminium studs 6 and the aluminium plate 5 serve as the means for providing a low-resistance electrical path between the anodes 1 and a source of electricity. Aluminium conductor bars 7 are welded to the underside of the aluminium plate 5. Connector tapes or flexibles (not shown) are in turn connected to the aluminium bars 7 and the source of electricity.

In order to prevent distortion of the anodes 1 during welding they may be provided with ribbing below the coated area. The titanium base plate 4 can be provided with drop-edges in order to stiffen the plate. The base plate 4 is provided with a drainage hole or holes (not shown). The anode assembly is conveniently supported on a mild steel frame (not shown).

An important advantage of the above described all-welded anode assembly is that single anodes can be removed from the assembly with ease simply by cutting the base of the anode 1 free from the support rib 2. The technique of welding the anode to the support member is particularly advantageous in the case of non-planar anodes.

In an alternative embodiment (not shown) the aluminium conductor plate 5 is replaced by vertical parallel aluminium connectors each of which is welded to a row of studs 6.

Figure 4:
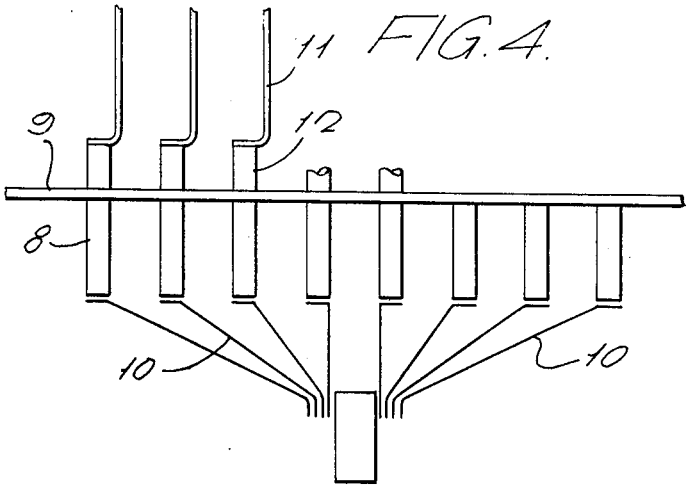
FIG. 4 is a schematic view of a capacitor discharge stud welded anode assembly according to the invention.

Referring now to FIG. 4 there is depicted another design of anode assembly according to the invention in which capacitor discharge stud welding has been used instead of friction welding. In this design a plurality of aluminium studs 8 are capacitor discharge stud welded to the underside of a titanium base plate 9. A plurality of thin aluminium sheet connectors 10 are then attached to the free ends of the studs 8 by means of argon-arc spot welding or by standard TIG welding. Flexibility between rows of studs 8 is achieved by the formed sheet connectors 10. Flexibility between individual studs can be achieved by forming loops or convolutions in the sheet connectors between the studs. As a result of this built in flexibility the titanium base plate 9 remains distortion free during fabrication and subsequent service. The coated titanium anodes 11 are attached to the top surface of the titanium base plate 9 by means of titanium studs 12 which are capacitor discharge stud welded to the base plate 9. The anodes 11 are connected to the upper ends of the titanium studs 12 by argon-arc spot welding.

What we claim is:

1. In a diaphragm cell for the electrolysis of aqueous solutions of alkali metal halides the improvement consisting of an anode assembly comprising a single-thickness base plate of an electrolyte resistant conductive metal having a plurality of metal anodes mounted on and electrically connected to the upper surface of the base plate and current lead-in means electrically and mechanically bonded to the under-surface of the base plate by means of a plurality of electrically conducting stud members each of which is connected by welding at one end to the under surface of the base plate and is connected at the other end to said current lead-in means.

2. A cell as in claim 1 wherein said stud members are bonded to the under surface of the base plate by friction welding.

3. A cell as in claim 1 wherein said stud members are bonded to the under surface of the base plate by capacitor discharge welding.

4. A cell as in claim 1 wherein the base plate is made from metal selected from titanium and titanium alloys.

5. A cell as in claim 1 wherein the current lead-in means and the stud members are made of metal selected from the group consisting of copper, aluminum, steel and titanium.

6. A cell as in claim 1 wherein the current lead-in means is a rigid sheet of metal.

7. A cell as in claim 1 wherein the current lead-in means is a series of parallel strips of metal each associated with a row of studs.

8. A cell as in claim 1 wherein the current lead-in means is a series of thin flexible sheets of metal each associated with a row of studs.

9. A cell as in claim 1 wherein the anode assembly includes a series of spaced parallel anode support members welded to the upper surface of the base plate, each of said support members having a plurality of anodes welded thereto.

10. A cell as in claim 9 wherein the anode support members are titanium ribs.

11. A cell as in claim 9 wherein the anode support members are titanium studs.

12. A cell as in claim 11 wherein the anode support studs are friction welded to the upper surface of the base plate.

13. A cell as in claim 11 wherein the anode support studs are capacitor discharge welded to the upper surface of the base plate.

* * * * *